United States Patent [19]

Savage

[11] Patent Number: 4,512,437

[45] Date of Patent: Apr. 23, 1985

[54] SAFETY VEST

[75] Inventor: Garry Savage, Montreal, Canada

[73] Assignee: Institut de Recherche en Sante et en Securite du Travail du Quebec, Quebec, Canada

[21] Appl. No.: 503,777

[22] Filed: Jun. 13, 1983

[30] Foreign Application Priority Data

May 6, 1983 [CA] Canada ..... 427637

[51] Int. Cl.[3] ..... A62B 35/00

[52] U.S. Cl. ..... 182/3; 119/96; 244/151 R

[58] Field of Search ..... 182/3-7; 244/151 R; 119/96

[56] References Cited

U.S. PATENT DOCUMENTS

| | | | |
|---|---|---|---|
| 1,967,767 | 7/1934 | Diez | 182/3 |
| 2,051,044 | 8/1936 | Hoffman | 244/151 R |
| 2,382,816 | 8/1945 | Quilter | 244/151 R |
| 2,464,719 | 3/1949 | Quilter | 244/151 R |
| 2,699,284 | 1/1955 | Rose . | |
| 2,960,180 | 11/1960 | Wachtel | 182/3 |
| 2,979,153 | 4/1961 | Hoagland et al. . | |
| 3,424,134 | 1/1969 | Rosenblum | 244/151 R |
| 3,475,774 | 11/1969 | Hawkins | 244/151 R |
| 3,701,395 | 10/1972 | Theobald . | |
| 3,869,021 | 3/1975 | Sutherland . | |
| 4,369,526 | 1/1983 | Clutts . | |

FOREIGN PATENT DOCUMENTS

| | | | |
|---|---|---|---|
| 2444474 | 8/1980 | France | 182/3 |
| 2501048 | 6/1981 | France | 182/3 |
| 343013 | 2/1931 | United Kingdom | 244/151 R |

*Primary Examiner*—Reinaldo P. Machado
*Assistant Examiner*—Alvin Chin-Shue
*Attorney, Agent, or Firm*—Cushman, Darby & Cushman

[57] ABSTRACT

The safety vest of the present disclosure comprises a front panel and a rear panel forming a torso encircling garment and displaying a plurality of strap receiving guide strips; a strap arrangement is associated with this garment and includes two main pairs of straps, each strap of the first pair forming a continuous detachable loop with a front portion, a back portion, a shoulder portion and a hip portion, and each strap of the second pair forming also a continuous detachable loop which is adapted to surround the thigh of a user and which is engaged with the lowermost part of the front portion of the first pair of straps; buckles are associated with each strap of each pair for detaching the loops.

9 Claims, 6 Drawing Figures

SAFETY VEST

FIELD OF THE INVENTION

The present invention relates to a safety vest and, more particularly, to a safety vest which is equipped with a strap arrangement for encircling the torso as well as the thighs of a user.

BACKGROUND OF THE INVENTION

Safety vests or harnesses which are used by persons engaged in an activity where there is the possibility of an accidental fall, such as, for example, when the person is working on a scaffold or walking on beams of highrise construction buildings, are known. One such harness may be found described in U.S. Pat. No. 2,699,284 issued Jan. 11, 1955 to Rose in which the impact exerted on the body of the worker as the result of the fall being stopped by a cable connecting the harness to an attachment point, is taken at specific locations of the body, such as the torso and the waist. One such safety and rescue vest may also be found in U.S. Pat. No. 3,701,395 issued Oct. 31, 1972 to Theobald in which the impact is taken by the side connections of the straps to the garment. In this patent, leg straps are also provided but they are also connected to the side connections. Hence, the impact of a fall is static and no means are provided to reduce the effect of a sudden stop.

Therefore, the harnesses and the safety vests of the prior art do not provide a dynamic stop and do not allow a prolonged suspension of the user after the fall, the forces applied on the torso or waist of the worker resulting very often in internal injury (thoracic, spinal) or asphyxiation.

OBJECTS AND STATEMENT OF THE INVENTION

It is an object of the present invention to provide a safety vest where the fall is substantially absorbed before impact by the user himself. This is achieved by providing an improved strap arrangement which forces the legs of the user to resist and to consequently reduce the impact exerted on the person wearing the vest.

It is another object of the present invention to provide a safety vest where a strap configuration allows greater distribution of the forces exerted when the cable connection abruptly stops the fall.

It is a further object of the present invention to provide a safety vest where the straps are maintained in their respective locations during all time.

It is a further object of the present invention to provide a strap configuration in a safety vest which will not obstruct the user while working.

The present invention therefore relates to a safety vest which comprises:

a front section and a rear section forming a torso encircling garment;

a plurality of strap guide means attached to the garment; and a strap arrangement associated with the guide means and the garment; the strap arrangement includes a first pair of separate straps, each forming a continuous detachable loop with a front portion, a back portion, a shoulder portion and a hip portion, and each passing through associated guide means on the garment; the front portion extending vertically over the garment; and a second pair of separate straps, each forming a continuous detachable loop adapted to surround the thigh of a user and engaging the lowermost part of the front portion of the first pair of straps; the safety vest also includes buckle means associated with each strap of each pair to detach the loops.

Other objects and further scope of applicability of the present invention will become apparent from the detailed description given hereinafter. It should be understood however, that this detailed description, while indicating preferred embodiments of the invention, is given by way of illustration only since various changes and modifications within the spirit and scope of the invention will become apparent to those skilled in the art.

DESCRIPTION OF THE PREFERRED EMBODIMENTS

Figure 3:
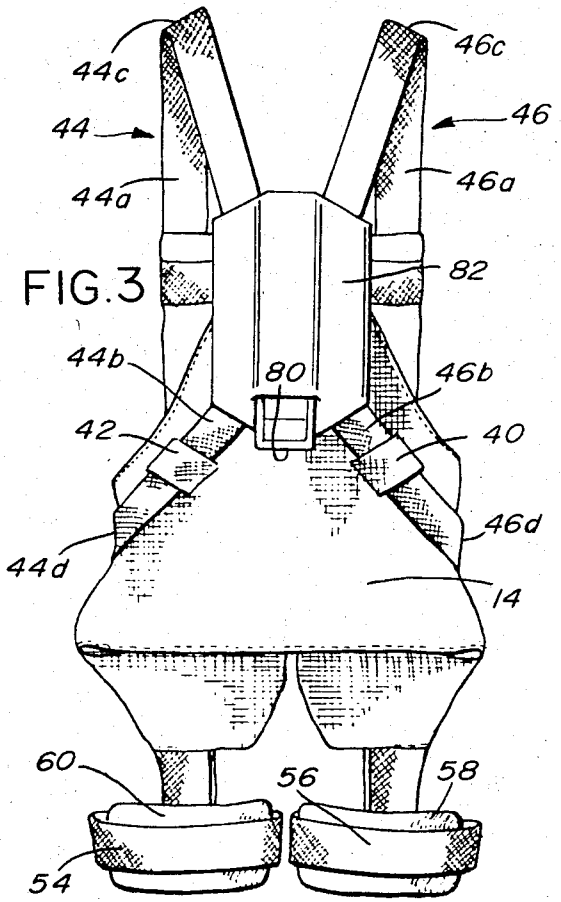
FIG. 3 is a rear elevational view thereof.

Referring to the drawings wherein like reference numerals refer to like parts throughout the several views, one form of the safety vest is indicated generally at 10 and comprises a front section 12 and a back section 14; these sections may form a single garment which displays on the front thereof a closure means 16, such as, for example a zipper, or it may also be formed of two separate panels which may be joined at their opposite sides 18 and 20 by means of permanently fixed or detachable fasteners such as indicated by reference numeral 22.

The material of the garment is one which is strong so as to resist tearing either during normal use or during an accidental fall of the user. The garment is provided with a series of loops or channels in the form of guide strips for allowing passage of straps therethrough as described hereinbelow. On the front panel 12, such guide strips are shown at the upper portion as 24 and 26, at an intermediate portion as 28 and 30 and at the lower portion as 32 and 34. Also, in the lower part of the front portion of the vest two guide strips 36 and 38 are disposed rearwardly of the two guide strips 32 and 34. These strips are either sewn to the garment or are integrally formed thereof. The guide means retain the straps close to the garment so that the straps will not obstruct the user when working. For the same reasons, the garment is sleeveless to facilitate working. The back panel 14 has two such guide strips illustrated as 40 and 42.

The present invention is particularly concerned with the configuration of the strap arrangement associated with the garment and the strap guide means. This arrangement comprises a first pair of straps, generally denoted 44 and 46, which are separate from one another and which extend on the left and right side of the user. The first pair of strap 44 forms a continuous detachable loop with a front portion **44*a*, a back portion 44*b*, a shoulder portion 44*c* and a hip portion 44*d*. Similarly the second strap 46 of this first pair forms also a continuous detachable loop with a front portion 46*a*, a back portion 46*b*, a shoulder portion 46*c*** and a hip portion 46*d*. The front portions 44*a* and 46*a* extend vertically from the shoulder portion to a lower-most part thereof through their respective guide strips 24, 28, 32 and 26, 30 and 34, respectively. The lower-most part of each vertical front portion is folded at 50 and 52, respectively, the rearmost portion of each folded portion joining a respective hip portion 44*d*, 46*d*.

The strap arrangement in accordance with the present invention includes a second pair of straps, generally denoted 54 and 56, each strap forming a detachable loop to encircle the thigh of the user. Each strap 54, 56 is engagedly received within the folded portion 50, 52 of the first pair of straps, 44, 46. The connection between the two pairs of straps is maintained at the frontmost of the user's leg, preferably a mid-thigh, by means of stitchings 55, 57. As shown in FIG. 3, the rear portion of straps 54 and 56 is equipped with pads 58 and 60 slidably mounted thereon.

The strap arrangement preferably includes a third pair of straps, denoted as 62 and 64, which extend horizontally at vertically spaced locations on the front of the vest and which serve to maintain the two separate strap portions 44*a* and 46*b* in the vertical position. Additionally, strap 64 serves to maintain the connection of straps 44 and 46 to straps 54 and 56 at the front thereof.

A plurality of buckles are used to detach the various loops formed by the straps. For example, buckles 68 and 70 are used in the chest area of the user in the front portion of straps 44 and 46 while buckles 72 and 74 are mounted to the straps 54 and 56 exteriorly with respect to the folded areas 50 and 52 of the straps. The location of these buckles is selected to prevent injury to the user and to be in area least likely to obstruct the user while working. Also, buckles 76 and 78 are disposed in the zipper area of the vest to connect straps 62 and 64. One example of such buckle is described in applicant's copending patent application filed concurrently herewith.

The safety vest of the present invention is specially adapted to be used for persons working on beans of high-rise buildings. A cable (not shown) is therefore required to secure the worker to the structure. This cable is connected to a hook 80 mounted to a fall absorbing device 82 secured to the back panel of the vest. The fall absorbing device not being part of the present invention, a detailed description thereof will not be given.

It will be observed that, upon an accidental fall of the worker, the particular strap configuration of the present invention will cause the body of the worker to adopt a foetal position due to the connection of straps 44 and 46 with their respective leg straps 54 and 56 at the front thereof. However, a conscious or unconscious reflex causes the user to oppose this position whereby the leg muscles provoke a dynamic stop, i.e. the stop is no longer sudden. This stop may be compared to the stop absorbed by the legs when one jumps down a step.

Figure 2:
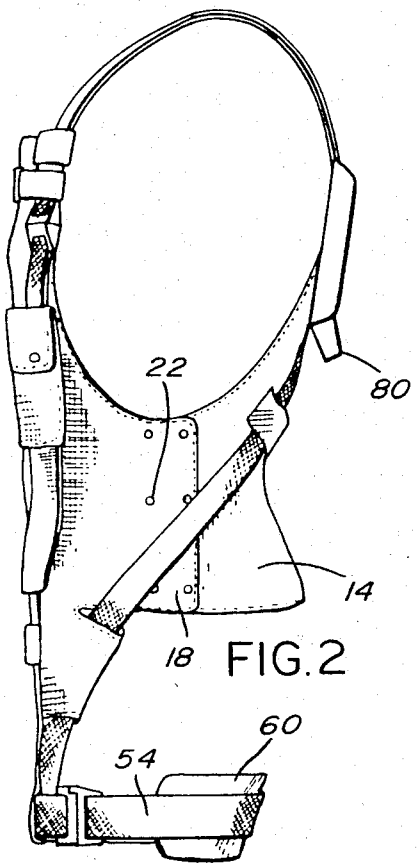
FIG. 2 is a side elevational view thereof.
Figure 1:
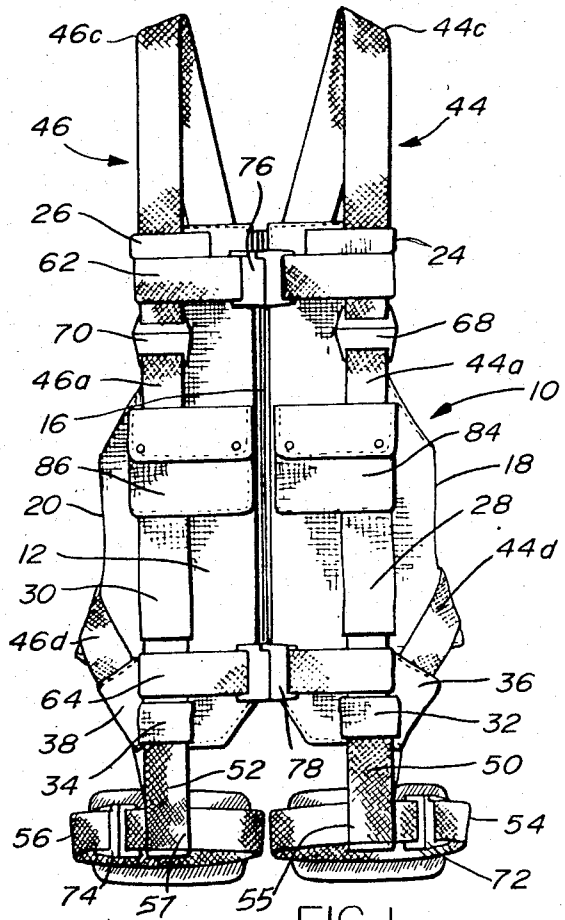
FIG. 1 is a front elevational view of the safety vest made in accordance with the present invention.
Figure 6:
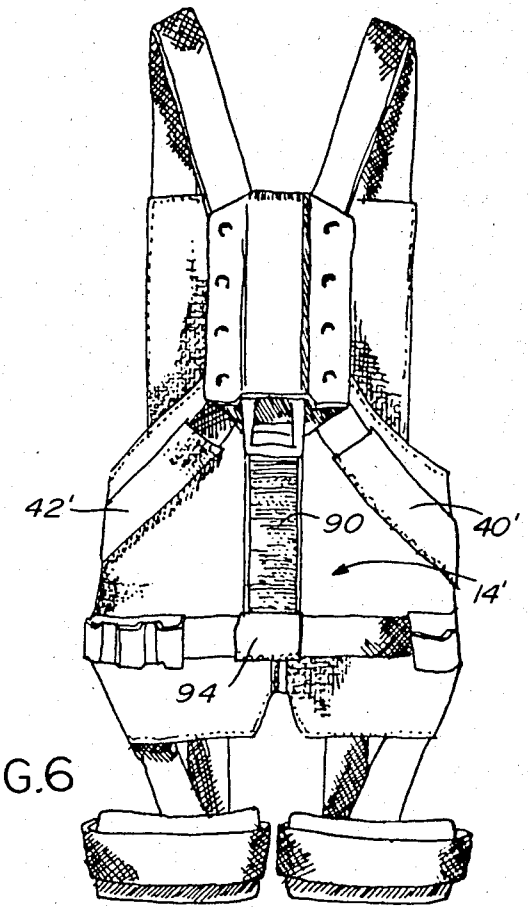
FIG. 6 is a rear view thereof.
Figure 5:
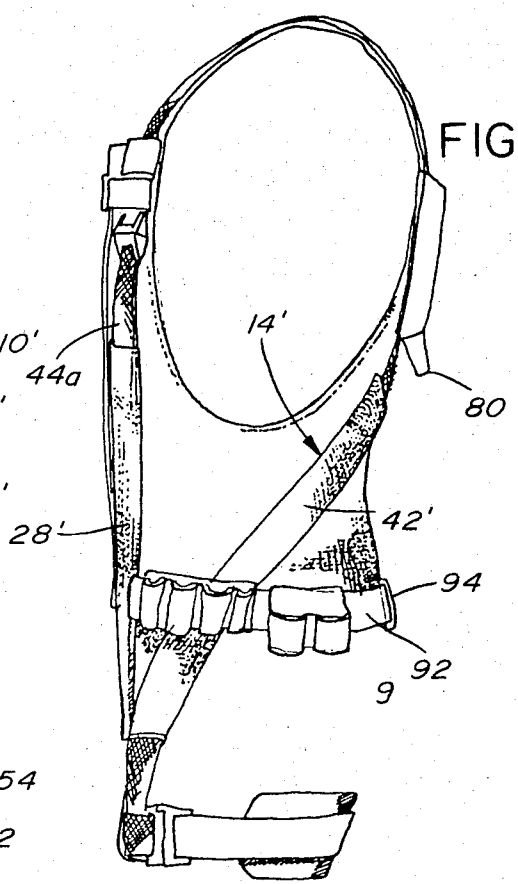
FIG. 5 is a side view thereof.
Figure 4:
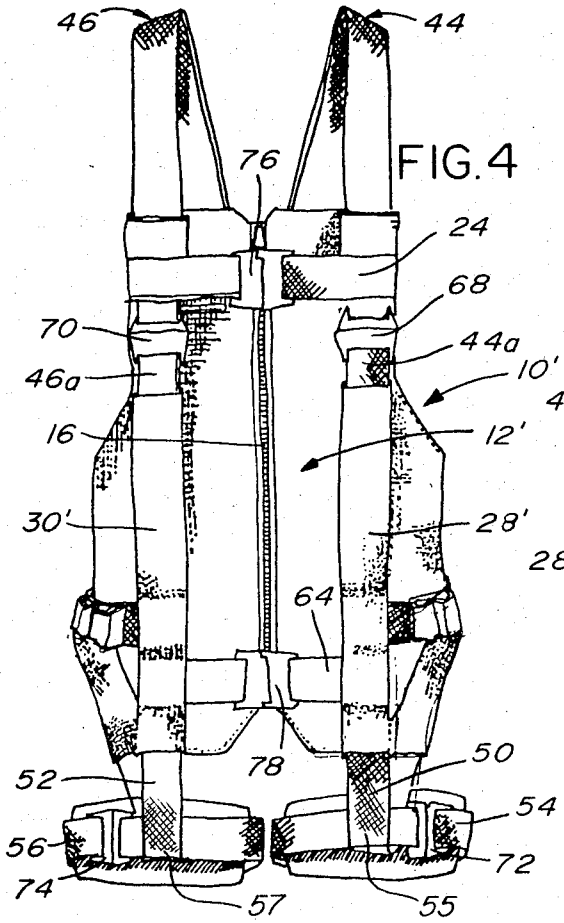
FIG. 4 is a front elevational view of another embodiment of a vest made in accordance with the present invention.

Referring to FIGS. 4, 5 and 6, another variant of a vest is shown wherein parts similar to the parts shown in FIGS. 1, 2 and 3 have the same reference numerals and wherein modified parts have the same numerals with a prime mark. For example, the garment 10′ includes a continuous front and back portion 12′, 14′ which are interconnected, at the front, by the zipper 16 and, at the back, by a conventional industrial elastic element 90. Also, the rear guides 42′ and 44′ have been extended over the entire hip portions of the garment. A utility belt 92 encircles part of the garment and extends through a rear loop 94 to the two vertical portions 44*a* and 46*a* of the first pair of straps. The guide channels 28′ and 30′ have been extended to cover a longer portion of the strap portions 44*a* and 46*a*. In this way, vertical movement of the strap 64 is prevented. Also, in this embodiment, pockets 84 and 86 of the vest of FIGS. 1, 2 and 3 have been removed.

Although the invention has been described with respect to one specific form of the invention, it will be evident to the person skilled in the art that it may be refined and modified in various ways. For example, straps 44 and 46 may cross at the rear of the vest in the fall absorbing device 82 so that each strap, while still defining a continuous separate loop, has now portions which extend on both sides of the user. It is therefore wished to have it understood that the present invention should not be limited in interpretation except by the terms of the following claims.

The embodiments of the invention in which an exclusive property or privilege is claimed are defined as follows:

1. A safety vest comprising:
(a) a front section and a rear section forming a torso encircling garment;
(b) a plurality of strap guide means attached to said garment;
(c) a strap arrangement associated with said guide means and said garment, said arrangement including
(i) a first pair of separate straps, each forming a continuous detachable loop with a front portion, a back portion, a shoulder portion and a hip portion, and each passing through associated guide means on said garment; said front portion extending vertically over said garment;
(ii) a second pair of separate straps, each forming a continuous detachable loop adapted to surround the thigh of a user and engaging a lower-most part of the front portion of said first pair of straps; the engagement of the second pair of straps to the lower-most part of the first pair of straps being at its front-most portions so that, at impact following an accidental fall, a major portion of the forces exerted on the strap arrangement are transmitted to the second pair of straps which cause the thighs to pivot and to provoke a dynamic resistance by the thigh muscles; and
(d) buckle means associated with each strap of each pair for detaching said loops.

2. A safety vest as defined in claim 1 further comprising a third pair of straps disposed over said front section and interconnecting said front portions of said first pair at vertically spaced locations; and buckle means associated with each strap of said third pair.

3. A safety vest as defined in claim 1, wherein said lowermost part of each front portion of each strap of said first pair is folded; each strap of said second pair being received in the folded area.

4. A safety vest as defined in claim 3, wherein said folded area defines a junction between said front portion and said hip portion.

5. A safety vest as defined in claim 1, wherein said front section of said garment includes closure means extending vertically and centrally thereof.

6. A safety vest as defined in claim 1, wherein said garment is sleeveless.

7. A safety vest as defined in claim 1, wherein each said strap of said second pair includes a pad slidably mounted thereon and disposed rearwardly of said lowermost part of said front portion.

8. A safety vest as defined in claim 1, further comprising a cable connecting unit attached to said back section; each said back portion of said first pair of straps engaging said unit.

9. A safety vest as defined in claim 1, wherein said buckle means of said second pair of straps are disposed outwardly relative to said lowermost part of said front portion of said first pair.

* * * * *